US006670856B1

(12) United States Patent
Mazzochette

(10) Patent No.: US 6,670,856 B1
(45) Date of Patent: Dec. 30, 2003

(54) TUNABLE BROADSIDE COUPLED TRANSMISSION LINES FOR ELECTROMAGNETIC WAVES

(75) Inventor: Joseph Mazzochette, Cherry Hill, NJ (US)

(73) Assignee: Lamina Ceramics, Westampton, NJ (US)

( * ) Notice: Subject to any disclaimer, the term of this patent is extended or adjusted under 35 U.S.C. 154(b) by 0 days.

(21) Appl. No.: 10/164,671

(22) Filed: Jun. 6, 2002

(51) Int. Cl.[7] ..... H01P 5/00

(52) U.S. Cl. ..... 331/24 R; 333/116; 333/134; 333/206

(58) Field of Search ..... 333/134, 204, 333/219, 116, 104, 136, 206, 24 R

(56) References Cited

U.S. PATENT DOCUMENTS 3,769,617 A * 10/1973 West ..... 333/136
4,891,612 A * 1/1990 Gleason et al. ..... 333/33
5,767,753 A * 6/1998 Ruelke ..... 333/116
5,825,263 A * 10/1998 Falt ..... 333/204

* cited by examiner

*Primary Examiner*—Michael Tokar
*Assistant Examiner*—Lam T. Mai
(74) *Attorney, Agent, or Firm*—Lowenstein Sandler PC

(57) ABSTRACT

In accordance with the invention, coupled transmission lines are fabricated in forms that are tolerant of manufacturing variation or can be readily tuned. In accordance with a first embodiment, the transmission line is formed with alternating overlapping edges for enhanced manufacturing tolerance. In a second embodiment, the line is provided one or more overlapping adjustment regions to permit tuning. A third embodiment has both alternating overlapping edges and one or more tuning regions.

7 Claims, 5 Drawing Sheets

TUNABLE BROADSIDE COUPLED TRANSMISSION LINES FOR ELECTROMAGNETIC WAVES

FIELD OF THE INVENTION

This invention relates to coupled transmission lines for electromagnetic waves and, in particular to coupled transmission lines that are tunable and/or tolerant of manufacturing variations.

BACKGROUND OF THE INVENTION

Coupled transmission lines are used to make a variety of high frequency electromagnetic wave devices (RF and microwave) including frequency selective filters, signal splitters, and combiners, and delay lines. A typical coupled transmission line comprises a pair of elongated conductive strips separated by an intervening layer of dielectric material. FIG. 1, which is prior art, illustrates a transverse cross section of a common form of a coupled transmission line 10 wherein a pair of conductive strips 11A and 11B are separated by a gap of spacing G on a dielectric substrate 12 having a dielectric constant E. This form of the transmission line where the strips 11A and 11B overlap across at least a portion of the gap is referred to as a broadside coupled line.

FIG. 2, also conventional, illustrates an alternative coupled transmission line 20 wherein the conductive strips 11A and 11B are partially offset across the gap G. The amount overlap between 11A and 11B is designated L. This type of transmission line is called an off-set broadside coupled transmission line.

In each form, the degree of coupling C between the two strips 11A and 11B is a key parameter in the function of the transmission lines and devices using them. C is inversely proportional to the gap spacing G, and jointly proportional to the square root of the dielectric constant E and the overlap L.

In the fabrication of coupled transmission lines, it is difficult to control with desired precision the degree of coupling C. Common methods for manufacturing broadside coupled lines include thin film and thick film circuit technology, laminated printed circuit board technology, low temperature cofired ceramic (LTCC) technology and high temperature cofired ceramic (HTCC) technology. In these technologies, the degree of coupling is affected by manufacturing variations in dielectric constant, conductor width, conductor-to-conductor misalignment and dielectric thickness. Accordingly, there is a need for a broadside coupled transmission line structure that is tolerant of normal manufacturing variation and/or can be readily tuned.

SUMMARY OF THE INVENTION

In accordance with the invention, coupled transmission lines are fabricated in forms that are tolerant of manufacturing variation or can be readily tuned. In accordance with a first embodiment, the transmission line is formed with alternating overlapping edges for enhanced manufacturing tolerance. In a second embodiment, the line is provided one or more overlapping adjustment regions to permit tuning. A third embodiment has both alternating overlapping edges and one or more tuning regions.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It is to be understood that these drawings are for purposes of illustrating the concepts of the invention and are not to scale.

DETAILED DESCRIPTION

Figure 1:
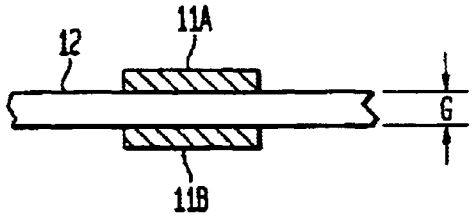
FIG. 1 (PRIOR ART)
FIGS. 1 and 2 are cross sectional illustrations of conventional coupled transmission lines.
Figure 2:
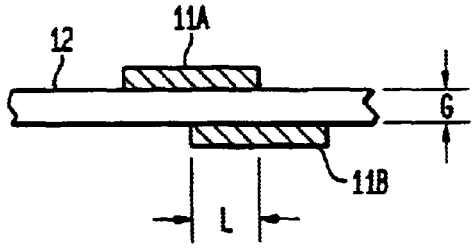
FIG. 2 (PRIOR ART)

FIGS. 1 and 2 show conventional coupled transmission lines described in the Background of the Invention.

Figure 3:
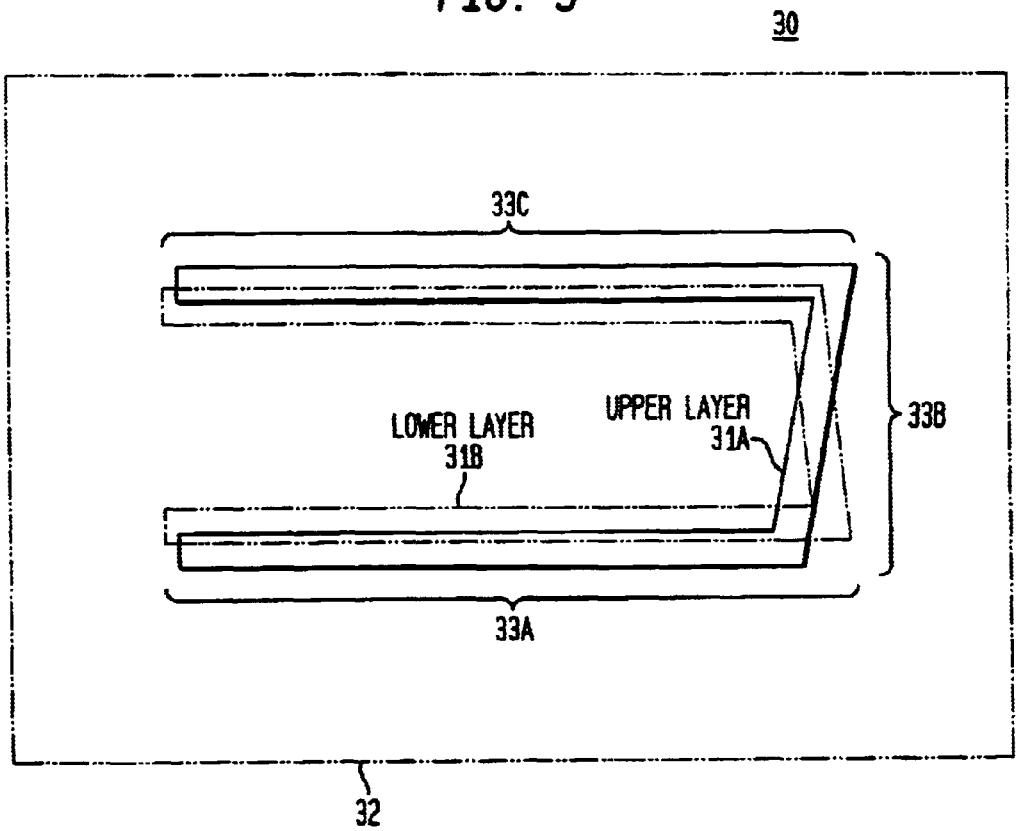
FIG. 3 illustrates a first embodiment of a fault tolerant transmission line formed with alternating overlapping edges.

FIG. 3 is a top view of an exemplary coupled transmission line 30 comprising strips 31A and 31B having alternating overlapping edges for enhanced manufacturing tolerance. The line 30 comprises a longitudinally extending first portion 33A where the "top" edge of strip 31A overlaps the "bottom" edge of underlying strip 31B. Line 30 further comprises a second longitudinally extending portion 33C where the "bottom" edge of strip 31A overlaps the "top" edge of underlying strip 31B. For each strip, the overlap edge thus alternates. Advantageously the length of portion 33A is approximately the same as the length of portion 33C. There is also a third transition portion 33C of line 30 where the edge overlaps switch sides. In the embodiment of FIG. 3, the line 30 is essentially directed in a 180° U-turn in the neighborhood of the transition portion 33C.

The advantage of this structure is tolerance of alignment errors in the fabrication of strips 31A and 31B on a dielectric substrate 32. It is relatively easy to control the configuration of all portions of strip 31A because all portions are on the same surface of the substrate 32. Similarly, while strip 31B is on a different surface of the substrate 32, all regions of 31B are on the same surface, permitting easy shape control. The conventional problem, however, is precisely aligning strip 31A on one major surface with strip 31B on the other major surface. The structure of FIG. 3 minimizes this problem because misalignment that reduces coupling in one portion, e.g. portion 33A, will increase coupling in the other portion, e.g. portion 33C. For small misalignments, the transition portion 33C is essentially self-compensating, as misalignment will only displace the location of the crossover region, not the degree of coupling. The circuit shown, in FIG. 3 can be fabricated, for example, using the DuPont LTCC System 951 described in the DuPont Material Data Sheet entitled "951 Low-Temperature Cofire Dielectric Tape."

Figure 4:
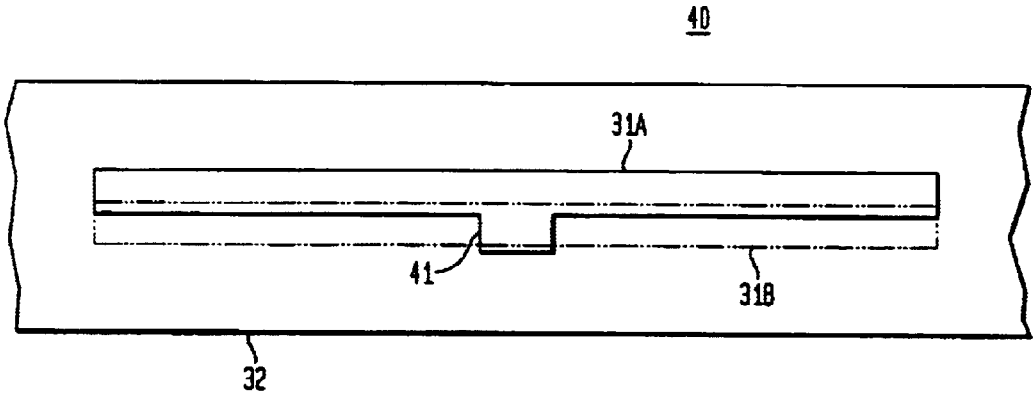
FIG. 4 shows a transmission line formed with an overlapping adjustment region to permit coupling adjustment.

FIG. 4 is a top view of an alternative transmission line structure 40 provided with a readily accessible tuning adjustment region 41. Here one edge of strip 31A partially overlaps strip 31B (one edge of 31B). Adjustment region 41 of strip 31A extends transversely to overlap a larger region of strip 31B. Region 41 provides a region of limited longitudinal extent which can be trimmed to decrease coupling between 31A and 31B until a desired value is reached. Region 41 can have a longitudinal length up to 20% of the length of strip 31A for ease of trimming. Lengths greater than 20% are not preferred because they tend to deteriorate the line impedance and produce unwanted signal reflections. The region 41 may be trimmed, for example, by etching, abrading, or laser trimming. Region 41 can be formed in the center, on the ends or anywhere along the coupled area of the lines 31A or 31B. It can be on either or both lines. There can be one region 41 or a multiplicity of such regions along the length of the line. And a single region 41 can be used to change the coupling coefficient of a plurality of adjacent lines on the same or different layers. While such trimming may affect the impedance of the transmission line, we will demonstrate by example below that it does not substantially deteriorate electrical performance.

Figure 5:
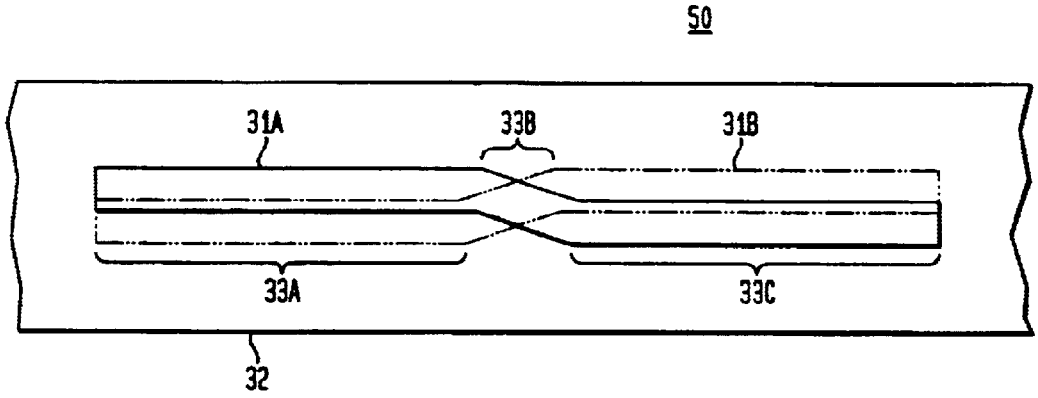
FIG. 5 illustrates a transmission line formed with both alternating overlapping edges and an overlapping adjustment region.

FIG. 5 is a top view of a coupled transmission line 50 designed for both manufacturing tolerance and provided with a trimming region 41. Here regions of alternating edge overlap 33A and 33C extend in the same direction and transition region 33B provides an area of full overlap for trimming.

The invention may now be more clearly understood by consideration of the following specific example.

Example

Figure 6:
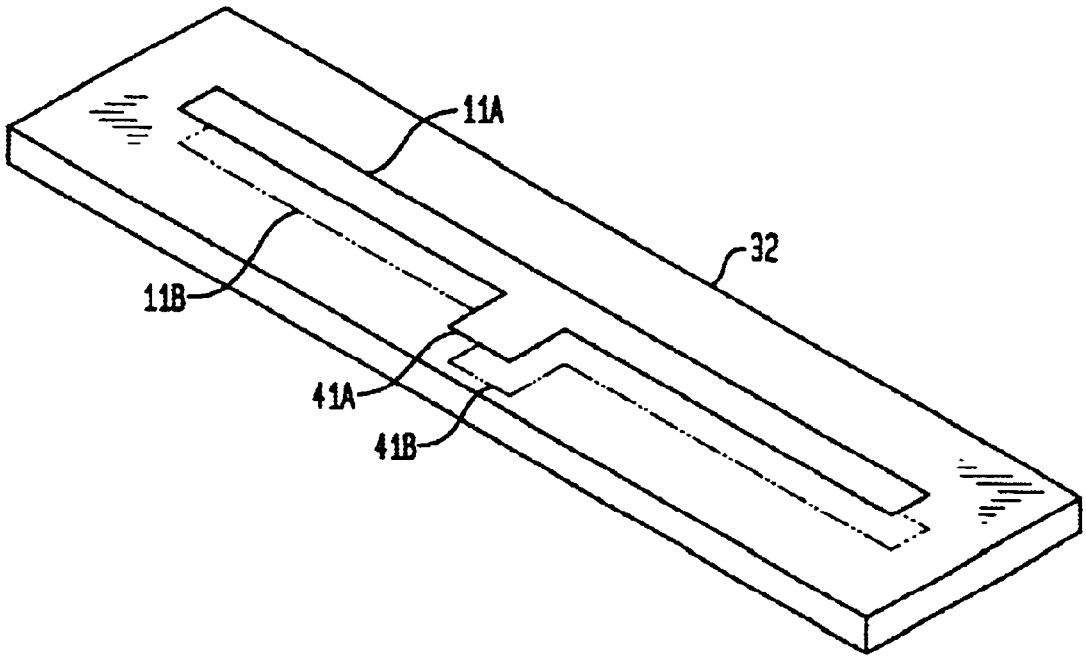
FIG. 6 shows a transmission line with overlapping upper and lower strip adjustment regions.

The FIG. 6 structure is similar to that shown in FIG. 1 except that it includes overlapping trimming regions 41A and 41B on strips 11A and 11B, respectively. Such structures are suitable for use as 3dB couplers. The FIG. 6 structure and a similar structure without regions 41A and 41B were fabricated for comparison tests. The two structures were then tested for degree of coupling and return loss.

The circuits were fabricated using a process similar to the aforementioned DuPont 951 process. Each tape is a mixture of organic binder and glass. When fired the tape formed the ceramic substrate for the circuit. Individual circuits were formed on a large wafer and then singulated after processing. Prior to firing, holes or vias were punched in the tape. The holes correspond to the location of electrical connections between the coupled lines and the connections out of the package. After punching, the vias were filled with silver conductor ink, which formed electrical connections between layers. Printing was accomplished using a squeegee printer and a metal stencil. After printing, the solvents in the material were dried at 70° C. for 30 minutes. Electrically conductive interconnections were then made by screen printing silver conductor ink. All conductor prints were dried.

After the via holes were filled and conductive traces were printed and dried, the separate tape layers were aligned, stacked, and tacked together using a high temperature (200° C.), 3 mm diameter tool. The stacked tapes were then laminated at 3000–4000 PSI at 70° C. After lamination, the assembly was heated to ~400° C. to burn off the organic materials in the tape layers. After burn-off, the assembly was heated to 850° C. to sinter the glass. After the assembly was removed from the furnace and cooled, the circuit formed a solid ceramic mass. Individual circuits were separated from the wafer by dicing.

Figure 7A:
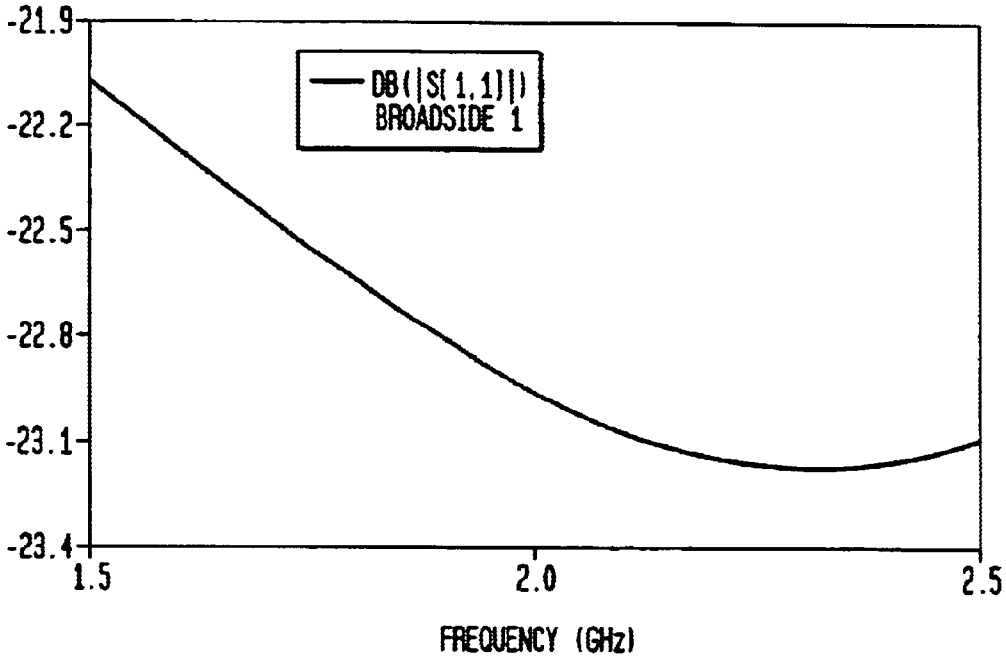
FIGS. 7A, 7B, 8A and 8B are graphical illustrations that show the characteristics of an exemplary embodiment.
Figure 7B:
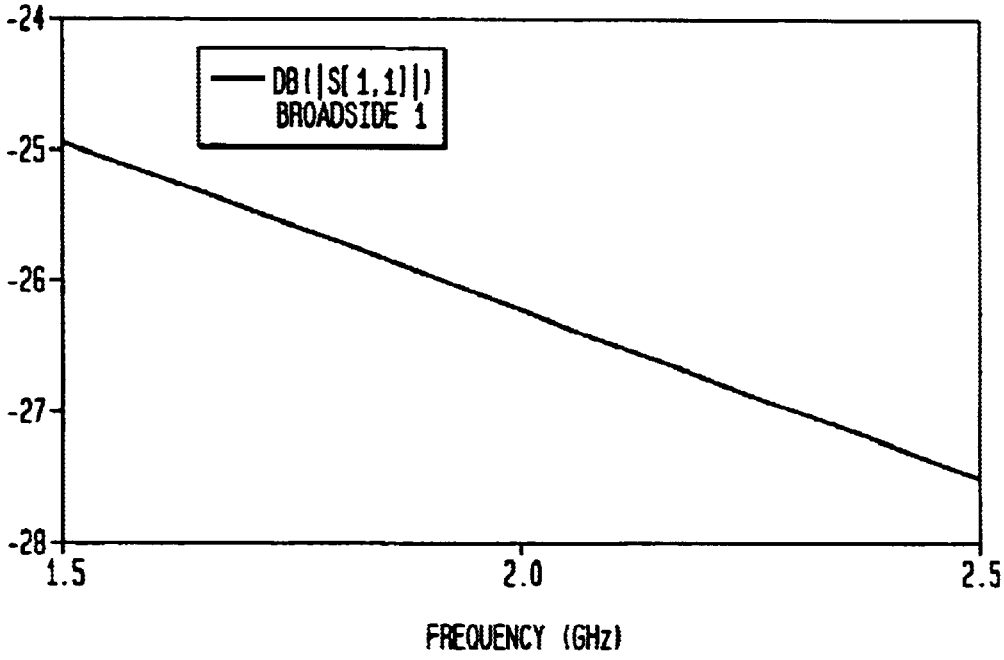
Figure 8A:
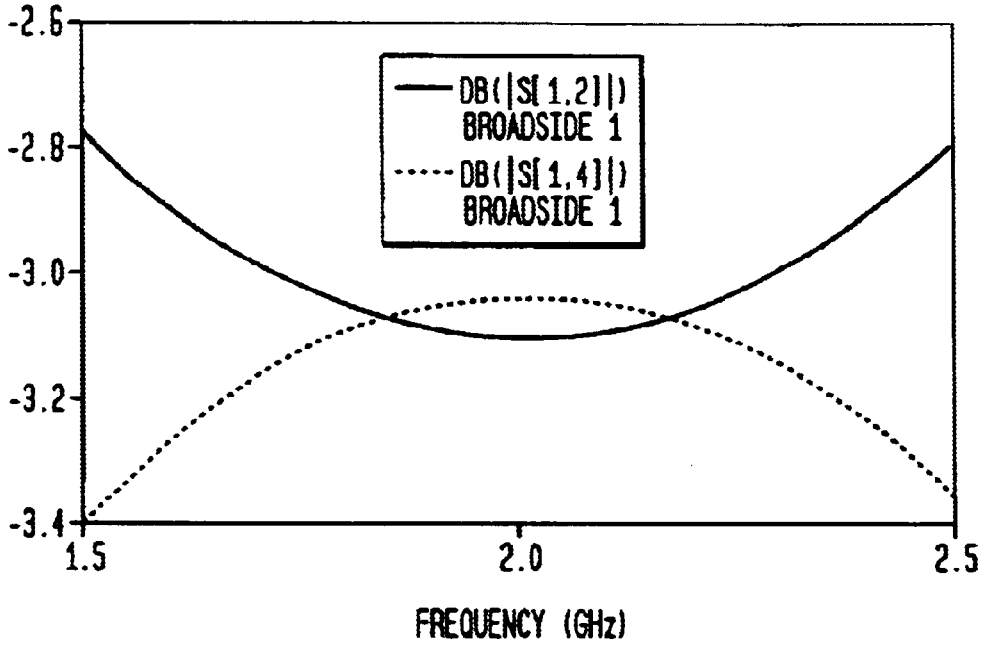
Figure 8B:
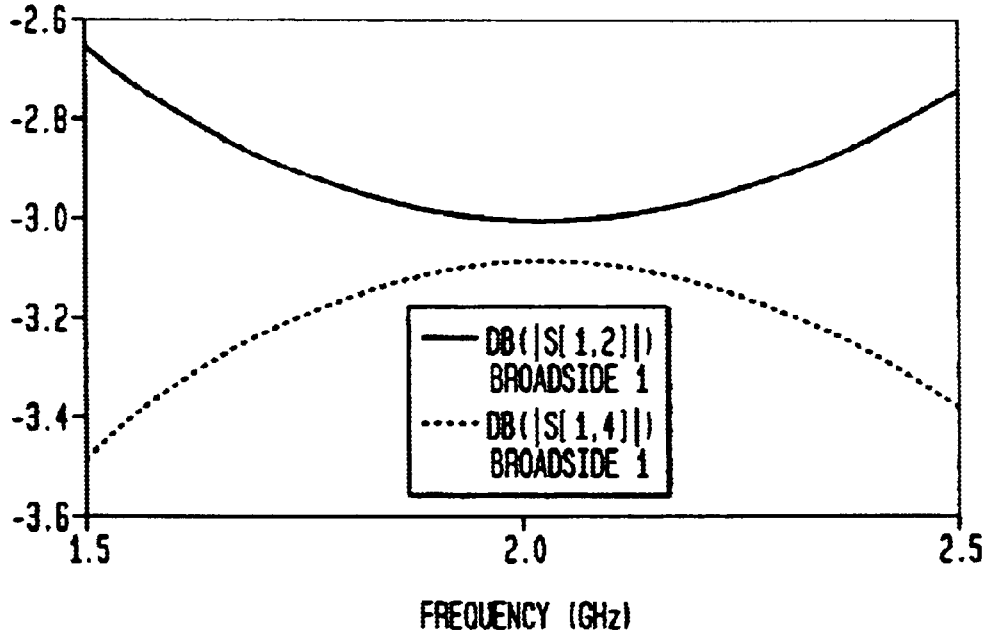

FIGS. 7A and 7B show the return loss with frequency for the FIG. 6 and FIG. 1 structures. FIGS. 8A and 8B illustrate coupling variation with frequency for the FIG. 6 structure and the FIG. 1 structure, respectively. As can be seen, the coupling variation and return loss are only slightly modified by the presence of the trimming regions.

It is understood that the above-described embodiments are illustrative of only a few of the many possible specific embodiments, which can represent applications of the invention. Numerous and varied other arrangements can be made by those skilled in the art without departing from the spirit and scope of the invention.

What is claimed is:

1. In a coupled transmission line for transmission of electromagnetic waves comprising a first longitudinally extending conductive strip separated from a second longitudinally extending conductive strip by a layer of dielectric material, the first and second strips partially overlapping across the layers of dielectric, the improvement wherein each of the conductive strips have first and second edges extending in the longitudinal direction and the first edge of the first strip overlaps the second strip over a first portion of the longitudinal extent of the line and the second edge of the first strip overlaps the second strip over a second portion of the longitudinal extent of the line, and the first strip crosses over the second strip in a third portion between the first and second portions of longitudinal extent, and the direction of the line reverses.

2. The improved transmission line of claim 1 wherein the first portion and the second portion are of substantially the same length.

3. In a coupled transmission line for transmission of electromagnetic waves comprising a first longitudinally extending conductive strip separated from a second longitudinally extending conductive strip by a layer of dielectric material, the first and second strips partially overlapping across the layers of dielectric, the improvement wherein each of the conductive strips have first and second edges extending in the longitudinal direction and the first edge of the first strip overlaps the second strip over a first portion of the longitudinal extent of the line and the second edge of the first strip overlaps the second strip over a second portion of the longitudinal extent of the line, and the first strip crosses over the second strip in a third portion between the first and second portions of longitudinal extent, wherein the line reverses direction near the third portion between the first and second portions.

4. The improved transmission line of claim 3 wherein the first portion and the second portion are of substantially the same length.

5. In a coupled transmission line for transmission of electromagnetic waves comprising a first longitudinally extending conductive strip separated from a second longitudinally extending conductive strip by a layer of dielectric material, the first and second strips at least partially overlapping across the layers of dielectric, the improvement wherein at least one of the conductive strips has a first width transverse to the longitudinal direction and at least one region of a second width greater than the first width, the second width overlapping the other conductive strip; and the second width is trimmed to tune the coupling between the two strips.

6. The improved transmission line of claim 5 wherein the first and second strips fully overlap and each of the first and second strips include regions of greater width for trimming, the regions of greater width overlapping each other.

7. In a coupled transmission line for transmission of electromagnetic waves comprising a first longitudinally extending conductive strip separated from a second longitudinally extending conductive strip by a layer of dielectric material, the first and second strips partially overlapping across the layers of dielectric, the improvement wherein each of the conductive strips have first and second edges extending in the longitudinal direction and the first edge of the first strip overlaps the second strip over a first portion of the longitudinal extent of the line and the second edge of the first strip overlaps the second strip over a second portion of the longitudinal extent of the line, and the first strip crosses over the second strip in a third portion between the first and second portions of longitudinal extent, wherein at least one of the conductive strips is trimmed in the third portion where the first strip crosses over the second strip to tune the coupling between the two strips.

* * * * *